US012708833B2

(12) United States Patent
Skurla, III et al.

(10) Patent No.: US 12,708,833 B2
(45) Date of Patent: Aug. 18, 2026

(54) ATTACHMENTS FOR AN UMBRELLA

(71) Applicant: Acushnet Company, Fairhaven, MA (US)

(72) Inventors: Peter J. Skurla, III, Bridgewater, MA (US); John Toracinta, Middletown, RI (US)

(73) Assignee: Acushnet Company, Fairhaven, MA (US)

( * ) Notice: Subject to any disclaimer, the term of this patent is extended or adjusted under 35 U.S.C. 154(b) by 102 days.

(21) Appl. No.: 18/392,627

(22) Filed: Dec. 21, 2023

(65) Prior Publication Data

US 2025/0204657 A1 Jun. 26, 2025

(51) Int. Cl.

| | |
|---|---|
| ***A63B 71/14*** | (2006.01) |
| ***A41D 19/00*** | (2006.01) |
| ***A45B 25/00*** | (2006.01) |
| ***A45F 5/02*** | (2006.01) |
| ***A47K 10/12*** | (2006.01) |

(52) U.S. Cl.

CPC ..... *A63B 71/146* (2013.01); *A41D 19/0034* (2013.01); *A41D 19/0037* (2013.01); *A45B 25/00* (2013.01); *A45F 5/021* (2013.01); *A47K 10/12* (2013.01); *A44D 2205/00* (2013.01); *A45B 2025/003* (2013.01); *A45B 2200/1009* (2013.01); *A63B 2209/10* (2013.01); *Y10S 224/933* (2013.01); *Y10T 24/318* (2015.01); *Y10T 24/45068* (2015.01)

(58) Field of Classification Search

CPC ..... Y10S 224/932; Y10S 224/933; A63B 43/005; A63B 71/146; A44D 2205/00; Y10T 24/318; Y10T 24/45068; A47K 10/12; A41D 19/0034; A41D 19/0037

USPC ..... 248/205.2; 224/933; 24/3.13, 302, 442

See application file for complete search history.

(56) References Cited

U.S. PATENT DOCUMENTS

| | | | | | |
|---|---|---|---|---|---|
| 2,710,409 | A | * | 6/1955 | Burandt | A41D 19/0034 2/160 |
| 2,754,532 | A | * | 7/1956 | Kanehl | A41B 15/00 2/48 |
| 4,088,136 | A | * | 5/1978 | Hasslinger | A61M 25/02 604/179 |
| 4,120,437 | A | * | 10/1978 | Hara | A63C 11/025 294/147 |
| 4,315,641 | A | * | 2/1982 | Larsen | A63C 11/2224 280/822 |
| D272,867 | S | * | 3/1984 | Gwaltney | D8/394 |

(Continued)

FOREIGN PATENT DOCUMENTS

| | | | | | |
|---|---|---|---|---|---|
| GB | 2496007 | A | * | 5/2013 | A63B 71/146 |
| JP | H09149809 | A | * | 6/1997 | |
| WO | WO-2019246023 | A1 | * | 12/2019 | E06B 9/80 |

*Primary Examiner* — Robert Canfield

(74) *Attorney, Agent, or Firm* — Kristin D. Wheeler

(57) ABSTRACT

Umbrella attachments for use during inclement weather to keep golf accessories, such as gloves and towels, dry during play. A glove tab is disclosed that secures to a stretcher of an umbrella allowing a flap of a glove to be secured to the glove tab to keep the glove dry when the umbrella is deployed during inclement weather. A towel hook is disclosed that secures to a stretcher of an umbrella allowing a towel to be secured to the hook portion of the towel hook to keep the towel dry when the umbrella is deployed during inclement weather.

11 Claims, 5 Drawing Sheets

(56) References Cited

U.S. PATENT DOCUMENTS 4,939,818 A * 7/1990 Hahn ..... B65D 63/10 D8/382
4,957,232 A * 9/1990 Sprague ..... A45F 5/04 224/904
5,136,759 A * 8/1992 Armour, II ..... A45F 3/14 24/442
5,142,743 A * 9/1992 Hahn ..... B65D 63/10 24/442
5,214,874 A * 6/1993 Faulkner ..... A01K 97/00 24/442
D397,840 S * 9/1998 Slocum ..... D2/891
5,845,374 A * 12/1998 Briggs ..... A63B 69/0059 24/442
5,957,141 A * 9/1999 Elkins ..... F16L 3/137 132/273
6,049,953 A * 4/2000 McCay ..... B60P 7/0823 24/302
6,076,789 A * 6/2000 Jackson ..... A45F 5/021 248/205.2
6,317,933 B1 * 11/2001 Suenaga ..... A44B 18/0088 24/442
6,546,599 B2 * 4/2003 Pelt ..... A45F 5/06 24/3.13
6,606,768 B2 * 8/2003 Henry ..... B62B 3/1456 24/3.13
6,694,575 B1 * 2/2004 Martin ..... A45F 5/02 206/315.3
7,640,640 B1 * 1/2010 Watkins ..... A43C 11/1493 24/712.3
8,245,362 B2 * 8/2012 Blevins ..... A63B 60/62 24/301
8,327,863 B1 * 12/2012 Dupree ..... A45F 5/00 248/500
8,458,864 B1 * 6/2013 Patton ..... A61F 5/3792 24/442
8,701,216 B1 * 4/2014 Evans ..... A41D 19/0037 2/161.2
9,339,086 B2 * 5/2016 Hill ..... B60P 7/0823
9,936,679 B2 * 4/2018 Roberdeaux ..... F16B 2/08
10,035,452 B2 * 7/2018 Hill ..... B60P 3/079
2001/0047607 A1 * 12/2001 Harvanek ..... A01K 97/06 43/21.2
2007/0075106 A1 * 4/2007 Meeh ..... A63B 55/408 224/274
2007/0277287 A1 * 12/2007 Jones ..... A41D 19/0041 2/159
2010/0306984 A1 * 12/2010 Fiore ..... A47K 10/14 24/680
2012/0280094 A1 * 11/2012 Post ..... A47G 25/10 248/205.2
2014/0054440 A1 * 2/2014 Cardie ..... A47K 10/12 248/610
2014/0263521 A1 * 9/2014 Hamilton ..... A45F 5/021 224/675
2014/0289930 A1 * 10/2014 Moss ..... A63B 71/146 2/161.4
2021/0330064 A1 * 10/2021 Malone ..... A41F 9/002

* cited by examiner

ATTACHMENTS FOR AN UMBRELLA

BACKGROUND

Golfers often need to store accessories, such as gloves or a towel, during play so they are easily accessible. Golf bags allow the golfer to store gloves or towels during play by hanging them on the outside of the golf bag for easy access. However, when it is raining keeping a towel or glove on the bag can result in the towel or glove getting wet, which is undesirable. A wet glove is undesirable when playing golf as it will not provide as good a grip. Similarly, a wet towel can defeat the purpose of drying items that get wet in the rain such as club grips. Thus, a better way to store items that are used throughout a round of golf, such as towels or gloves, during inclement weather is desired.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe systems and methods for an improved mechanism to store items during a game of golf and inclement weather. In an aspect, the present technology relates to an accessory that can be used with an umbrella to store items, such as gloves and towels during play such that they will not get wet.

In an example, a glove tab is provided for use on a stretcher of an umbrella, the glove tab includes a strip with a top surface, a first end and a second end. The strip has a first portion provided with a hook or loop fastener, a fold line provided adjacent to the first portion, a second portion provided adjacent to the fold line and provided with the other of a hook or loop fastener, and a third portion provided adjacent to the second portion and having a portion with a hook or loop fastener. The first portion may be folded and removably secured to the second portion along the fold line over a stretcher of a deployed umbrella thereby securing the glove tab to the stretcher of an umbrella. The third portion being capable of removably securing a glove strap to the third portion. The first portion may have a hook material and the second portion as a loop material. Alternatively, the first portion has a loop material and the second portion has a hook material. The hook or loop fastener may cover substantially a majority top surface of the third portion. The strip has a width of about 0.5 and about 3 inches. Preferably, the width is about 1 and about 2 inches. The has a length of about 4 and about 8 inches. Preferably, the length is about 5 and about 7 inches. In another embodiment, the first portion has a first length and the second portion has a second length and the first length and second length are substantially equal. Preferably, a third length of the third portion is greater than the first length of the first portion or the second length of the second portion. The third portion may have a back surface and the back surface may be provided with a hook or loop fastener. The glove tab strip may further include a fourth portion and a fifth portion directly adjacent to the fold line. The fourth portion has a first side directly adjacent the fold line and a second side directly adjacent to the first portion. The fifth portion has a first side directly adjacent the fold line and a second side directly adjacent to the second portion. The fourth portion and fifth portion may have a sticky surface.

In another embodiment, a towel hook is provided for use on a stretcher of an umbrella, the towel hook having a strip with a top surface, a first end and a second end. The strip has a first portion provided with a hook or loop fastener, a fold line provided adjacent to the first portion, a second portion provided adjacent to the fold line and having the other of a hook or loop fastener, a third portion provided adjacent to the second portion, and a hook secured to the third portion. The first portion may be folded and removably secured to the second portion along the fold line over a stretcher of a deployed umbrella thereby securing the towel hook to the stretcher of an umbrella, the hook may be capable of removably securing a towel to the hook. The first portion has a hook material and the second portion as a loop material. Alternatively, the first portion has a loop material and the second portion has a hook material. The third portion may have a second end the hook being secured to the second end of the third portion. The strip has a width of about. 0.5 to about 3 inches. The strip has a length of about 3 to about 6 inches. The first portion may have a first length and second portion may have a second length and the first length and second length are substantially equal. The towel hook may further have a fourth portion and a fifth portion directly adjacent to the fold line. The fourth portion has a first side directly adjacent the fold line and a second side directly adjacent to the first portion. The fifth portion has a first side directly adjacent the fold line and a second side directly adjacent to the second portion. The fourth portion and fifth portion may have a sticky surface.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

DETAILED DESCRIPTION

As discussed above, being able to store items used during a round a golf so that they are both accessible and protected from getting wet is desirable. Storage that is usable in wet-weather environments have a variety of features that improve the protection, comfort, and/or utility of the items such as gloves or towels. While the present application primarily discusses the technology in terms of a glove or towel, it should be appreciated that the features discussed herein may be used with other items needed during play which the feature would be beneficial.

Among other things, the present technology includes glove tab or towel hook that are removably secured to the inside stretcher of an umbrella when the umbrella is deployed during inclement weather. The glove towel or towel hook may removably secure any items, such as a glove or a towel, under the umbrella during inclement weather thereby preventing any such items from getting wet during a round of golf played during inclement weather.

Figure 1:
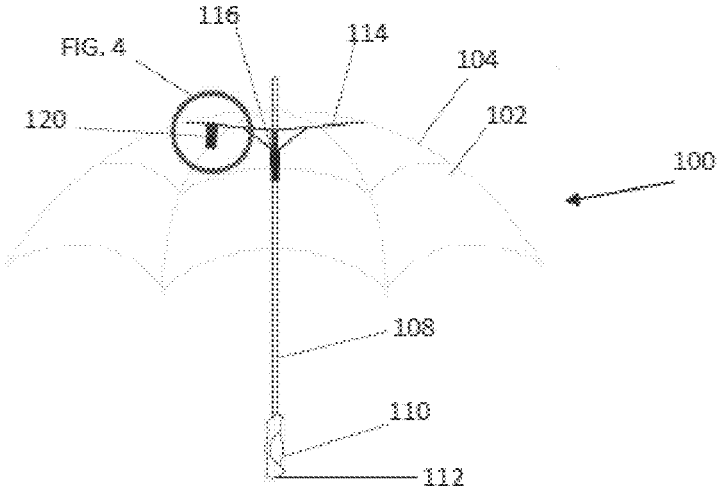
FIG. 1 depicts a cross-sectional view along a mid-line of a deployed umbrella with a glove tab secured to an umbrella stretcher.

FIG. 1 depicts a cross-sectional view taken down the center of a typical umbrella 100 featuring a canopy 102 supported by a frame 104 made up of ribs 106 that the canopy is stretched over. The frame 104 and canopy 102 are supported by a shaft 108 which features a handle 110 at a distal end 112. A stretcher 114 extends from each rib 106 to a runner 116 that slides over the shaft 108 and a top spring allows the runner 116 to be slid up the shaft 108 to open the canopy 102 or to be slid down the shaft 108 to close the canopy 102. A glove tab 120 is shown secured to one of the stretchers 114.

Figure 2:
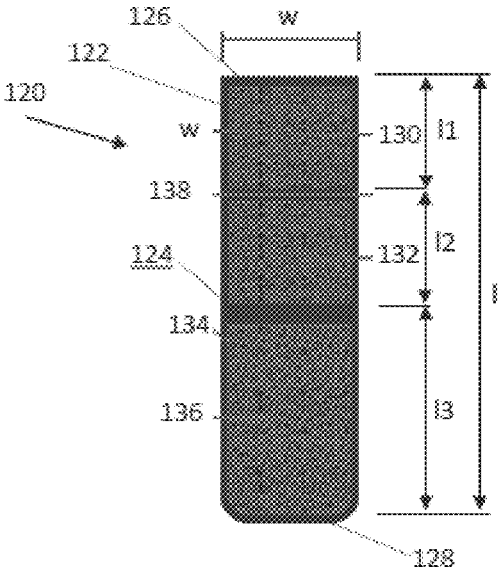
FIG. 2 depicts a front view of a glove tab.
Figure 3:
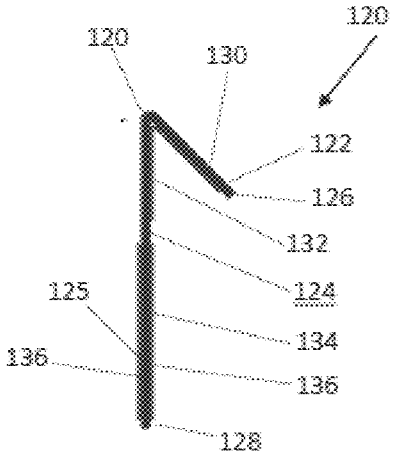
FIG. 3 depicts a side view of the glove tab of FIG. 2 partially folded.
Figure 4:
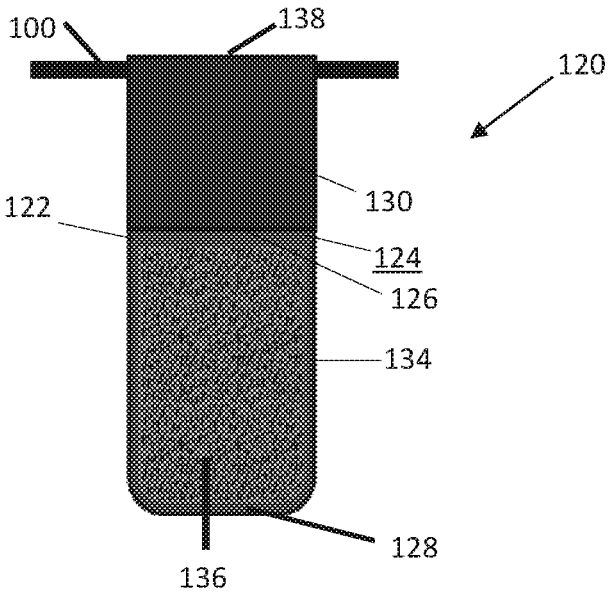
FIG. 4 depicts a front view of the glove tab of FIG. 2 folded over an umbrella stretcher to secure the glove tab to the stretcher.

In FIGS. 2-4, the glove tab 120 is shown according to the present invention. The glove tab 120 comprises a flexible strip 122 that has a width w of about 0.5 to about 3 inches, and preferably about 1 to about 2 inches, most preferably about 1.5 inches. The strip has a total length l of about 4 to about 8 inches, preferably about 5 to about 7 inches. The strip comprises a flexible material such as a fabric, preferably a nylon webbing. The strip 122 has a top surface 124, a first end 126 and a second end 128 and is divided into portions, including a first portion 130 provided at the first end 126, a second portion 132 provided adjacent the first portion and a third portion 134 provided adjacent the second portion and extending to the second end 128 of the strip 122. The first portion 130 has a length $l_1$, the second portion 132 has a length $l_2$ and the third portion 134 has a length $l_3$.

The first, second and third portions 130, 132, 134 of the strip 122 are provided with a hook and loop fastener 136 covering at least half of each portion on the top surface 124 of the strip 122. The hook and loop fasteners 136 may be secured to the top surface 124 by any suitable means including adhesive or stitching. As is known, the hook portion features a rough surface, and the loop surface features a soft surface such that the hook and loop portions may be removably secured together. Any suitable hook and loop fastener may be used, such as VELCRO® Brand fasteners. Preferably, the third length $l_3$ of the third portion 134 of the strip 122 is greater than both the first length $l_1$ of the first portion 130 or the second length $l_2$ of the second portion 132. The third length $l_3$ of the third portion 134 may about equal to the first length $l_1$ and second length $l_2$ combined. Generally, the first length $l_1$ of the first portion 130 and the second length $l_2$ of the second portion 132 are substantially equal. Preferably, the hook and loop fastener 136 on the first and second portions 130, 132 covers the majority of the top surface 124 of the first and second portions 130, 132. Preferably, the hook and loop fastener 136 on the third portion 134 covers the majority of the top surface 124 of the third portion 134. Optionally, as shown in FIG. 3, the back surface 125 of the third portion 134 may be provided with hook and loop fastener 136.

Figure 5:
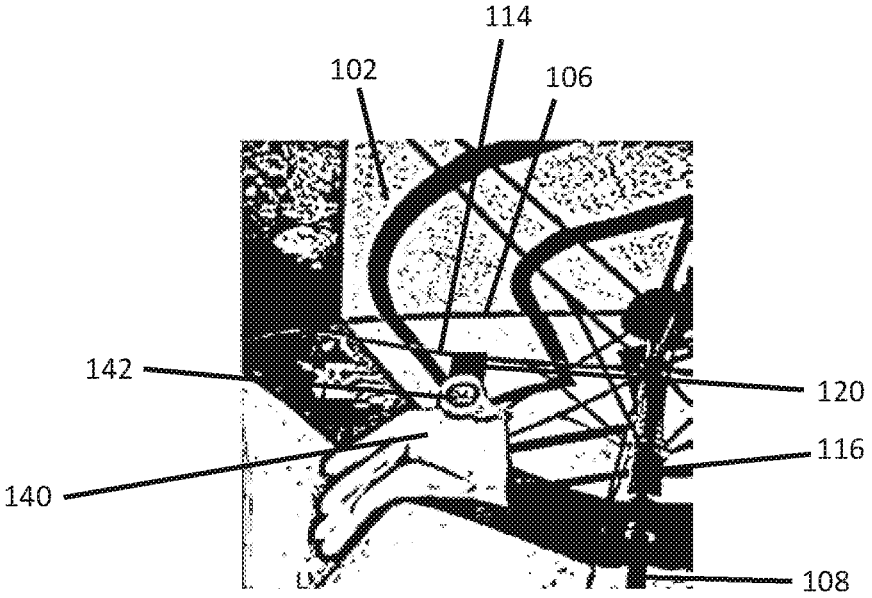
FIG. 5 depicts perspective view of a portion of an interior of a deployed umbrella having the glove tab secured to the stretcher with a glove secured to the glove tab.

A fold line 138 is provided between the first portion 130 and second portion 132. FIG. 2 shows the first portion 130 being folded at the fold line 138 to removably secure the first portion 130 to the second portion 132. As shown in FIG. 3 a stretcher 114 of an umbrella 100 is placed at the fold line 138 and the first portion 130 is removably secured to the second portion 132 about the stretcher 114 to removably secure the glove tab 120 to the stretcher 114 of the umbrella 100. As is shown, preferably the first portion 130 features the hook portion of the hook and loop fastener 136, while the second portion 132 features the loop portion of the hook and loop fastener 136. However, will be appreciated that the first portion 130 may feature the loop portion of the hook and loop fastener 136, while the second portion 132 may feature the hook portion. After the glove tab is removably secured to the stretcher, the exposed third portion 134 of the glove tab 120 is capable of being used to secure items, such as a glove, to the exposed hook and loop fastener on the third portion 134. Preferably, the third portion 134 is provided with the hook portion of the hook and loop fastener. FIG. 5 shows an inside view of a deployed umbrella 100 with the glove tab 120 being removably secured to a stretcher 114 of the umbrella 100. An accessory, such as a glove 140, may be removably secured to the glove tab 120 by using a glove strap 142 of the glove 140 with a hook and loop fastener to removably secure the glove 140 to the glove tab 120. Thus, the glove 140 may be kept under the canopy 102 of the umbrella 100 while not in use so that the glove 140 may stay drier during inclement weather.

Figure 6:
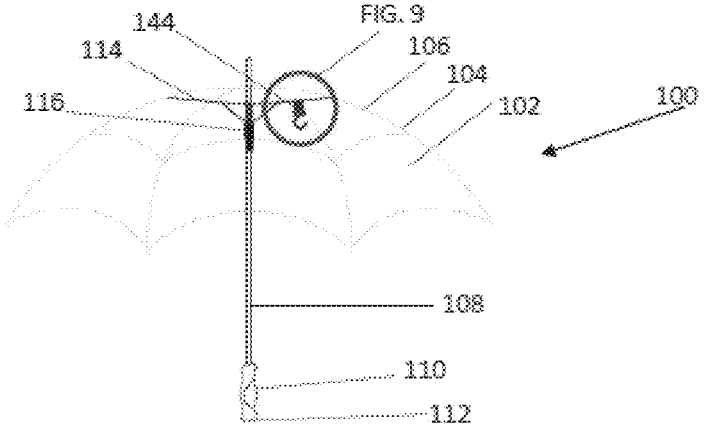
FIG. 6 depicts a cross-sectional view along a mid-line of a deployed umbrella with a towel hook secured to an umbrella stretcher.

FIG. 6 depicts a cross-sectional view taken down the center of the umbrella 100, as shown and described in FIG. 1, featuring the canopy 102 supported by the frame 104 made up of ribs 106 that the canopy is stretched over. The frame 104 and canopy 102 are supported by the shaft 108 which features the handle 110 at the distal end 112. Stretchers 114 extends from each rib 106 to the runner 116 that slides over the shaft 108 and the top spring allows the runner 116 to be slid up the shaft 108 to open the canopy 102 or to be slid down the shaft 108 to close the canopy 102. A towel hook 144 is shown secured to one of the stretchers 114.

Figure 7:
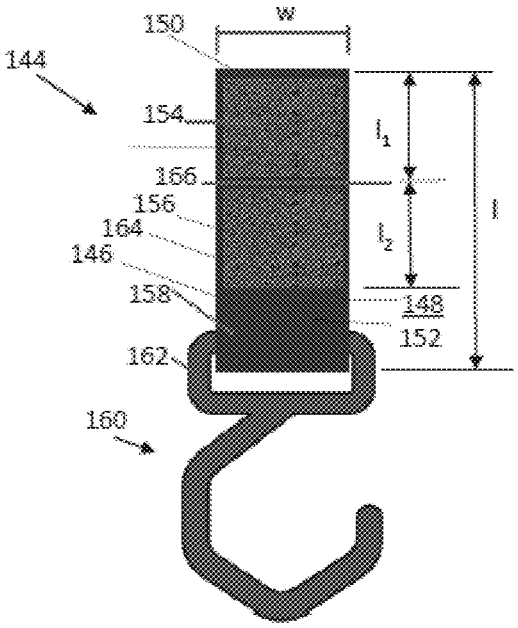
FIG. 7 depicts a front view of a towel hook.
Figure 8:
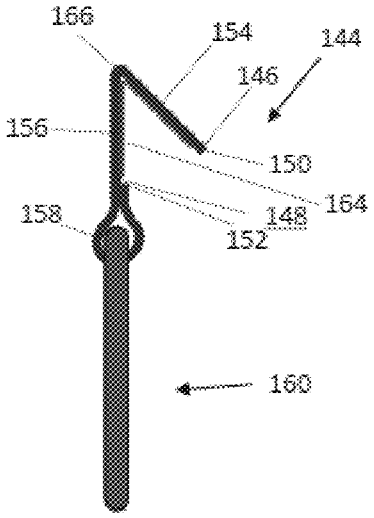
FIG. 8 depicts a side view of the towel hook of FIG. 7 partially folded.
Figure 9:
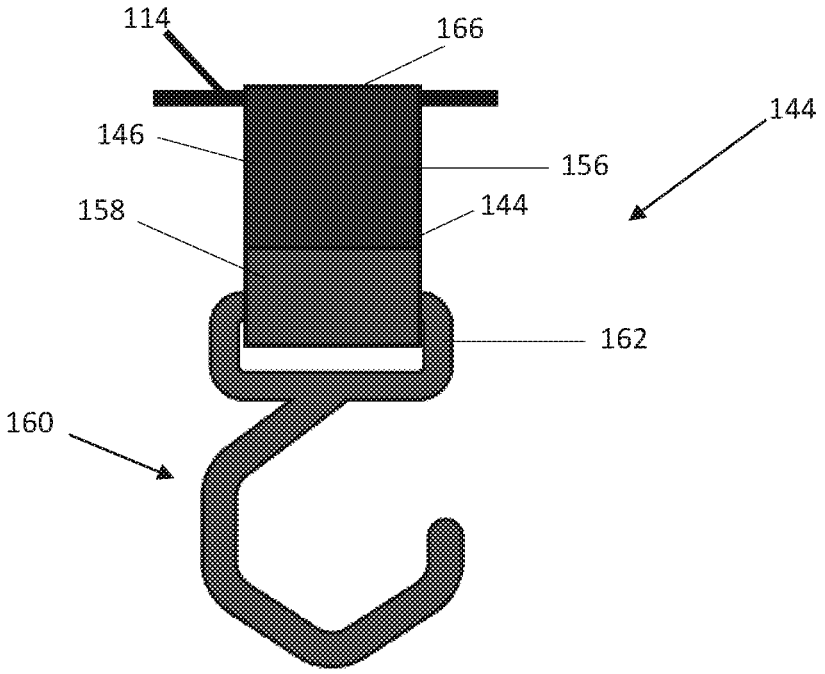
FIG. 9 depicts a front view of the towel hook of FIG. 7 folded over an umbrella stretcher to secure the towel hook to the stretcher.

In FIGS. 7-9, a towel hook 144 is shown according to the present invention. The towel hook 144 comprises a flexible strip 146 that has a width w of about 0.5 to about 3 inches, and preferably about 1 to about 2 inches, most preferably about 1.5 inches. The strip 146 has a total length l of about 2 to about 6 inches, preferably about 2.5 to about 4 inches. The strip 146 comprises a flexible material such as a fabric, preferably a nylon webbing. The strip 146 has a top surface 148, a first end 150 and a second end 152 and is divided into portions, including a first portion 154 provided at the first end 150, a second portion 156 provided adjacent the first portion 154 and a third portion 158 provided adjacent the second portion and extending to the second end 152 of the strip 146. The first portion 154 has a length $l_1$, the second portion 132 has a length $l_2$.

The third portion 158 is secured to a hook 160. Preferably, the second end 152 of the strip 146 is wrapped around a hook base 162 and secured to the top surface 148 of the strip on the third portion 158. The second end 152 may be secured by any suitable means, including stitching. It will be appreciated that the hook 160 may be secured to the third portion 158 by any suitable means. The hook may be any suitable hook, including a carabiner or even a buckle clasp. The hook may be made of any suitable material, including metal or plastic.

The first portion 154 and second portion 156 of the strip 146 are provided with a hook and loop fastener 164 covering at least half of each portion on the top surface 148 of the strip 146. The hook and loop fasteners 164 may be secured to the top surface 148 by any suitable means including adhesive or stitching. As is known, the hook portion features a rough surface, and the loop surface features a soft surface such that the hook and loop portions may be removably secured together. Any suitable hook and loop fastener may be used, such as VELCRO® Brand fasteners. Preferably, the first length $l_1$ of the first portion 154 and the second length $l_2$ of the second portion 156 are substantially equal. Preferably, the hook and loop fastener 164 on the first and second portions 154, 156 covers the majority of the top surface 148 of the first portion 154 and second portion 156.

Figure 10:
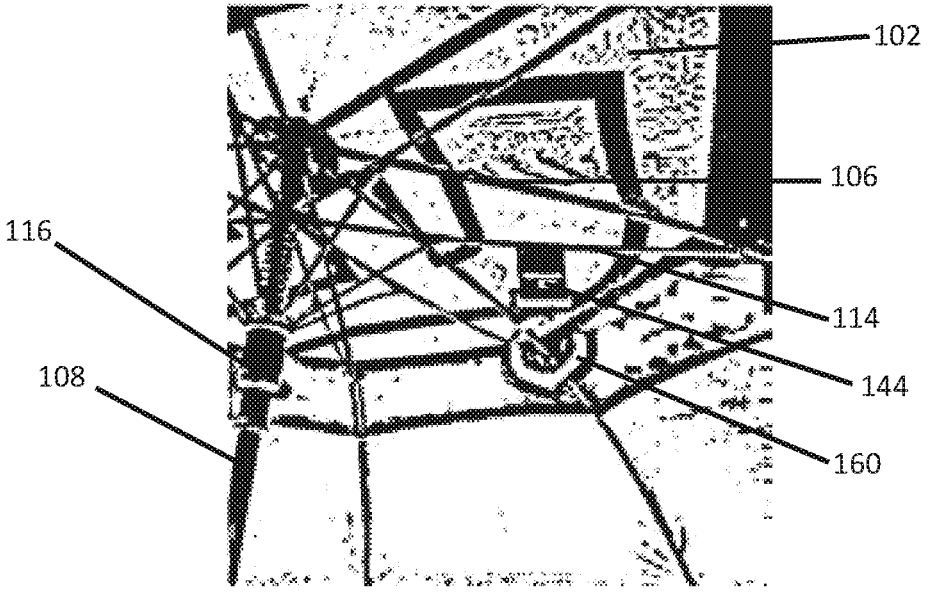
FIG. 10 depicts a perspective view of a portion of an interior of a deployed umbrella having the towel hook secured to the stretcher for receiving a towel.

A fold line 166 is provided between the first portion 154 and second portion 156. FIG. 2 shows the first portion 154 being folded at the fold line 166 to removably secure the first portion 154 to the second portion 156. As shown in FIG. 9, a stretcher 114 of an umbrella 100 is placed at the fold line 166 and the first portion 154 is removably secured to the second portion 156 about the stretcher 114 to removably secure the towel hook 144 to the stretcher 114 of the umbrella 100. As is shown, preferably the first portion 154 features the hook portion of the hook and loop fastener 164 while the second portion 156 features the loop portion of the hook and loop fastener 164. It However, will be appreciated that the first portion 154 may feature the loop portion of the hook and loop fastener 164, while the second portion 156 may feature the hook portion. The hook 160 on the third portion 158 of the towel hook 144 is capable of being used to secure items, such as a towel, to the extended hook 160. FIG. 10 shows an inside view of a deployed umbrella 100 with the towel hook 144 being removably secured to a stretcher 114 of the umbrella 100. An accessory, such as a towel, may be removably secured to the towel hook 144 by using a strap of the towel placed over the hook 160. Thus, the towel may be kept under the canopy 102 of the umbrella 100 while not in use so that the towel may stay drier during inclement weather.

Figure 11:
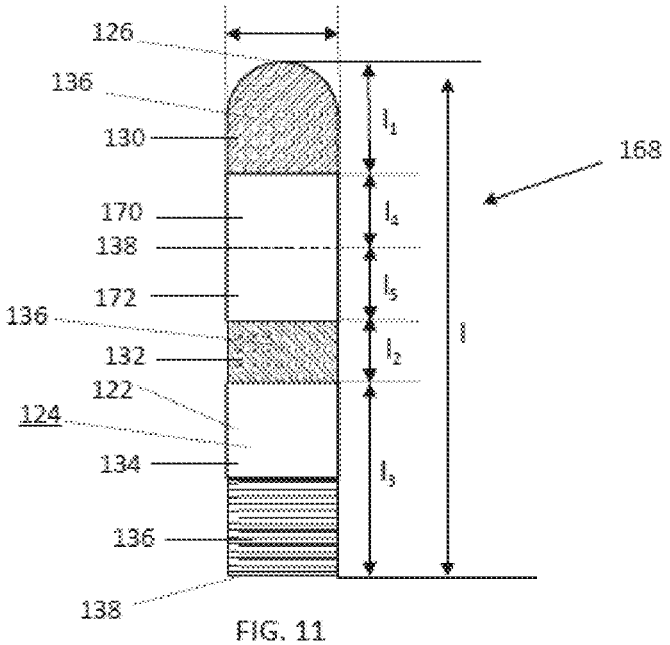
FIG. 11 depicts a front view of an alternative glove tab according to the invention.

FIG. 11 shows another embodiment of a glove tab 168. The glove tab 168 is substantially the same as the glove tab 120 described with regard to FIGS. 1-5. The glove tab 168 additionally features a fourth portion 170 and a fifth portion 172 provided directly adjacent the fold line 138 on either side and directly adjacent to the first portion and second portions respectively. The fourth portion has a first side directly adjacent the fold line and a second side directly adjacent to the first portion. The fifth portion having a first side directly adjacent the fold line and a second side directly adjacent to the second portion. The fourth portion 170 and fifth portion 172 may feature a sticky material to provide additional securing of the stretcher 114 at the fold line 138 by mating the fourth portion 170 to the fifth portion 172 and the first portion 130 to the second portion 132. The sticky material may be any suitable sticky material such as an adhesive or other known material. The fourth portion 170 has a fourth length $l_4$ and the fifth portion 172 has a fifth length $l_5$. Preferably the fourth length $l_4$ and fifth length $l_5$ are substantially equal. The fourth length $l_4$ and fifth length $l_5$ are preferably equal to or less than the first length $l_1$ and second length $l_2$. The glove tab 168 is removably secured to the stretcher 114 of the umbrella 100 in the same manner and may removably store accessories, such as the glove 140, as described above with regard to FIGS. 1-5. Thus, the glove 140 may be kept under the canopy 102 of the umbrella 100 while not in use so that the glove 140 may stay drier during inclement weather.

Figure 12:
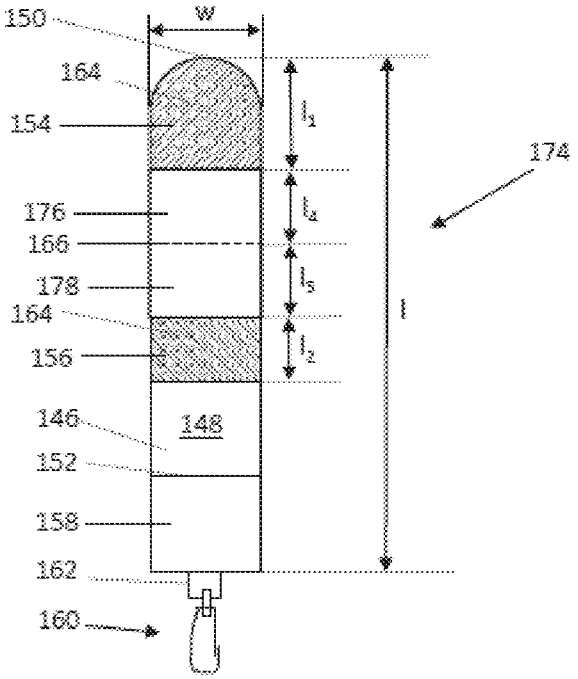
FIG. 12 depicts a front view of an alternative towel hook according to the invention.

FIG. 12 shows another embodiment of a towel hook 174. The towel hook 174 is substantially the same as the towel hook 144 described with regard to FIGS. 6-10. The towel hook 174 additionally features a fourth portion 176 and a fifth portion 178 provided directly adjacent fold line 166 on either side and directly adjacent to the first portion 154 and second portion 156 respectively. The fourth portion has a first side directly adjacent the fold line and a second side directly adjacent to the first portion and the fifth portion has a first side directly adjacent the fold line and a second side directly adjacent to the second portion. The fourth portion 176 and fifth portion 178 may feature a sticky material to provide additional securing of the stretcher 114 at the fold line 166 by mating the fourth portion 176 to the fifth portion 178 and the first portion 154 to the second portion 156. The sticky material may be any suitable sticky material such as an adhesive or other known material. The fourth portion 176 has a fourth length $l_4$ and the fifth portion 178 has a fifth length $l_5$. Preferably the fourth length $l_4$ and fifth length $l_5$ are substantially equal. The fourth length $l_4$ and fifth length $l_5$ are preferably equal to or less than the first length $l_1$ and second length $l_2$. The towel hook 174 is removably secured to the stretcher 114 of the umbrella 100 in the same manner and may removably store an accessory, such as the towel, as described above with regard to FIGS. 6-10. Thus, the towel may be kept under the canopy 102 of the umbrella 100 while not in use so that the towel may stay drier during inclement weather.

Although specific devices have been recited throughout the disclosure as performing specific functions, one of skill in the art will appreciate that these devices are provided for illustrative purposes, and other devices may be employed to perform the functionality disclosed herein without departing from the scope of the disclosure. This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art. Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or components are disclosed only as illustrative embodiments. The scope of the technology is defined by the following claims and any equivalents therein.

What is claimed is:

1. A glove tab for use on a stretcher of an umbrella, the glove tab comprising:

a strip with a top surface, a first end and a second end, the strip having;

a first portion provided with a hook or loop fastener;

a fold line provided adjacent to the first portion;

a second portion provided adjacent to the fold line provided with the other of a hook or loop fastener; and a third portion provided adjacent to the second portion and having a portion with a hook or loop fastener, wherein the first portion may be folded and removably secured to the second portion along the fold line over a stretcher of a deployed umbrella thereby securing the glove tab to the stretcher of an umbrella, the third portion capable of removably securing a glove strap to the third portion, further comprising a fourth portion and fifth portion directly adjacent to the fold line, the fourth portion having a first side directly adjacent the fold line and a second side directly adjacent to the first portion, the fifth portion having a first side directly adjacent the fold line and a second side directly adjacent to the second portion, the fourth portion and fifth portion having a sticky surface.

2. The glove tab of claim 1, wherein the first portion has a hook material and the second portion as a loop material.

3. The glove tab of claim 1, wherein the first portion has a loop material and the second portion has a hook material.

4. The glove tab of claim 1, wherein the hook or loop fastener covers substantially a majority top surface of the third portion.

5. The glove tab of claim 1, wherein the strip has a width of about 0.5 to about 3 inches.

6. The glove tab of claim 5, wherein the width is about 1 to about 2 inches.

7. The glove tab of claim 1, wherein strip has a length of about 4 to about 8 inches.

8. The glove tab of claim 7, wherein the length is about 5 to about 7 inches.

9. The glove tab of claim 1, wherein the first portion has a first length and the second portion has a second length and the first length and second length are substantially equal.

10. The glove tab of claim 9, wherein a third length of the third portion is greater than the first length of the first portion or the second length of the second portion.

11. The glove tab of claim 10, wherein the third portion has a back surface, the back surface provided with a hook or loop fastener.

* * * * *